US010967945B2

(12) United States Patent
Wright

(10) Patent No.: US 10,967,945 B2
(45) Date of Patent: Apr. 6, 2021

(54) AIR PROPELLER ASSEMBLY

(71) Applicant: Andrew Wright, Port St Lucie, FL (US)

(72) Inventor: Andrew Wright, Port St Lucie, FL (US)

( * ) Notice: Subject to any disclaimer, the term of this patent is extended or adjusted under 35 U.S.C. 154(b) by 0 days.

(21) Appl. No.: 16/553,320

(22) Filed: Aug. 28, 2019

(65) Prior Publication Data

US 2021/0061428 A1 Mar. 4, 2021

(51) Int. Cl.
*B63H 7/02* (2006.01)
*B63H 21/14* (2006.01)

(52) U.S. Cl.
CPC ..... *B63H 7/02* (2013.01); *B63H 21/14* (2013.01)

(58) Field of Classification Search
CPC ..... B63H 7/02; B63H 20/06; B63H 20/08
See application file for complete search history.

(56) References Cited

U.S. PATENT DOCUMENTS

| | | | | |
|---|---|---|---|---|
| 2,987,281 | A | 6/1961 | Schurr | |
| 3,016,869 | A * | 1/1962 | Anderson | B63H 20/08 440/56 |
| 3,188,995 | A | 6/1965 | Barten | |
| 4,239,172 | A * | 12/1980 | Spitzmesser | B63H 20/06 248/641 |
| 4,406,634 | A * | 9/1983 | Blanchard | B63H 20/12 248/642 |
| 4,932,839 | A * | 6/1990 | Pitchford | B60V 1/14 416/246 |
| 5,791,948 | A | 8/1998 | LeCompte | |
| 7,297,035 | B2 | 11/2007 | Broussard | |
| D670,228 | S | 11/2012 | Gilk | |
| 2012/0094555 | A1 | 4/2012 | Drinkard | |

* cited by examiner

*Primary Examiner* — Andrew Polay

(57) ABSTRACT

An air propeller assembly for moving a boat in shallow water includes a mount that can be mounted on a gunwale of a boat. A rod slidably is slidably coupled to the mount and the rod is rotatable about a vertical axis. A plate is coupled to the rod such that the plate is horizontally oriented when the mount is positioned on the gunwale. A steering handle is coupled to and extending away from the plate for steering. A motor is coupled to the plate and a propeller is coupled to the motor. The motor rotates the propeller when the motor is turned on. Additionally, the propeller agitates the air when the propeller is rotated to urge the boat through shallow water.

9 Claims, 5 Drawing Sheets

AIR PROPELLER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to propeller devices and more particularly pertains to a new propeller device for moving a boat in shallow water.

(2) Description of Related Art Including Information Disclosed Under 37 CFR 1.97 and 1.98

The prior art relates to propeller devices.

BRIEF SUMMARY OF THE INVENTION

An embodiment of the disclosure meets the needs presented above by generally comprising a mount that can be mounted on a gunwale of a boat. A rod slidably is slidably coupled to the mount and the rod is rotatable about a vertical axis. A plate is coupled to the rod such that the plate is horizontally oriented when the mount is positioned on the gunwale. A steering handle is coupled to and extending away from the plate for steering. A motor is coupled to the plate and a propeller is coupled to the motor. The motor rotates the propeller when the motor is turned on. Additionally, the propeller agitates the air when the propeller is rotated to urge the boat through shallow water.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
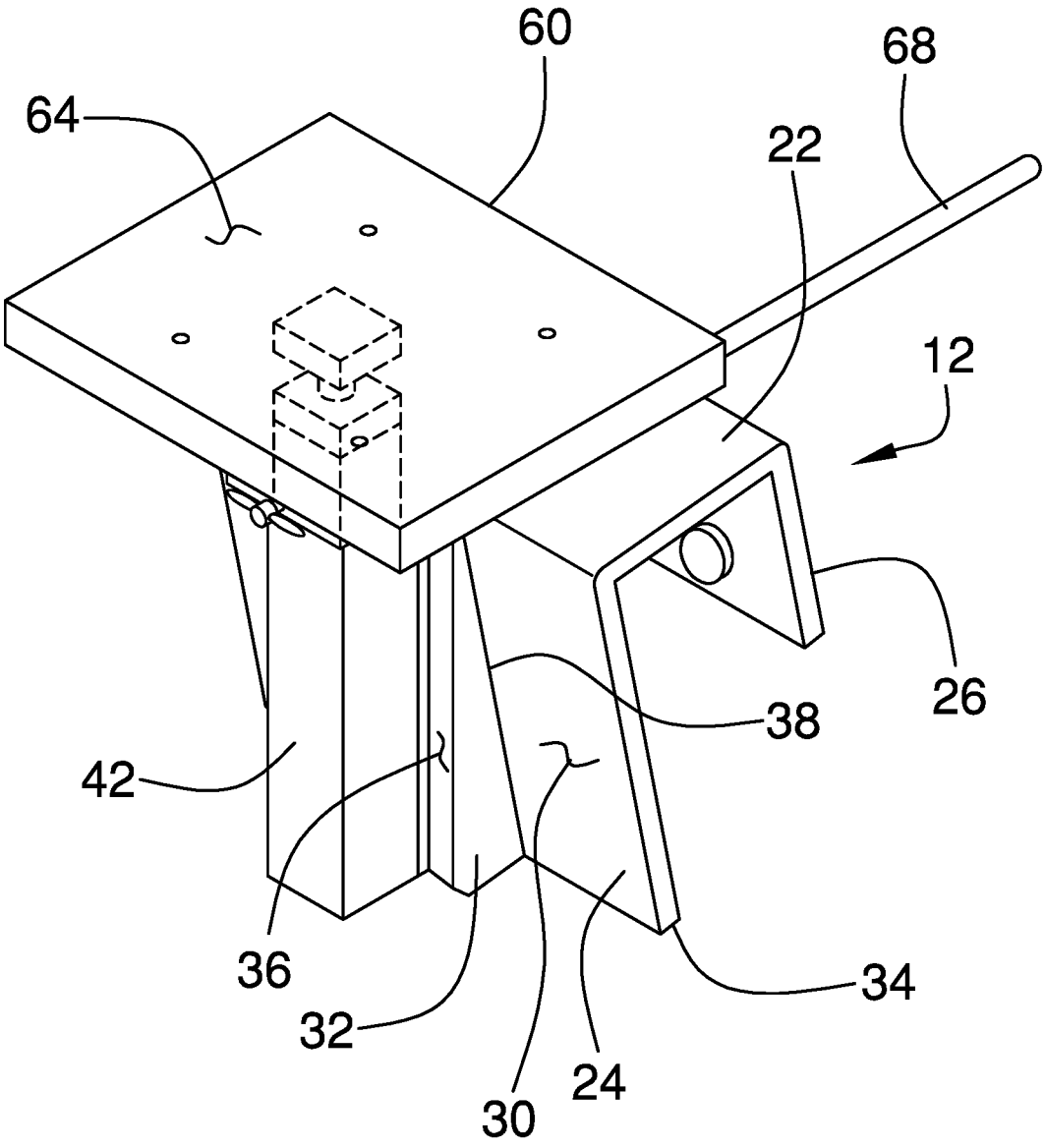
FIG. 1 is a phantom perspective view of a mount and a plate of an air propeller assembly according to an embodiment of the disclosure.
Figure 2:
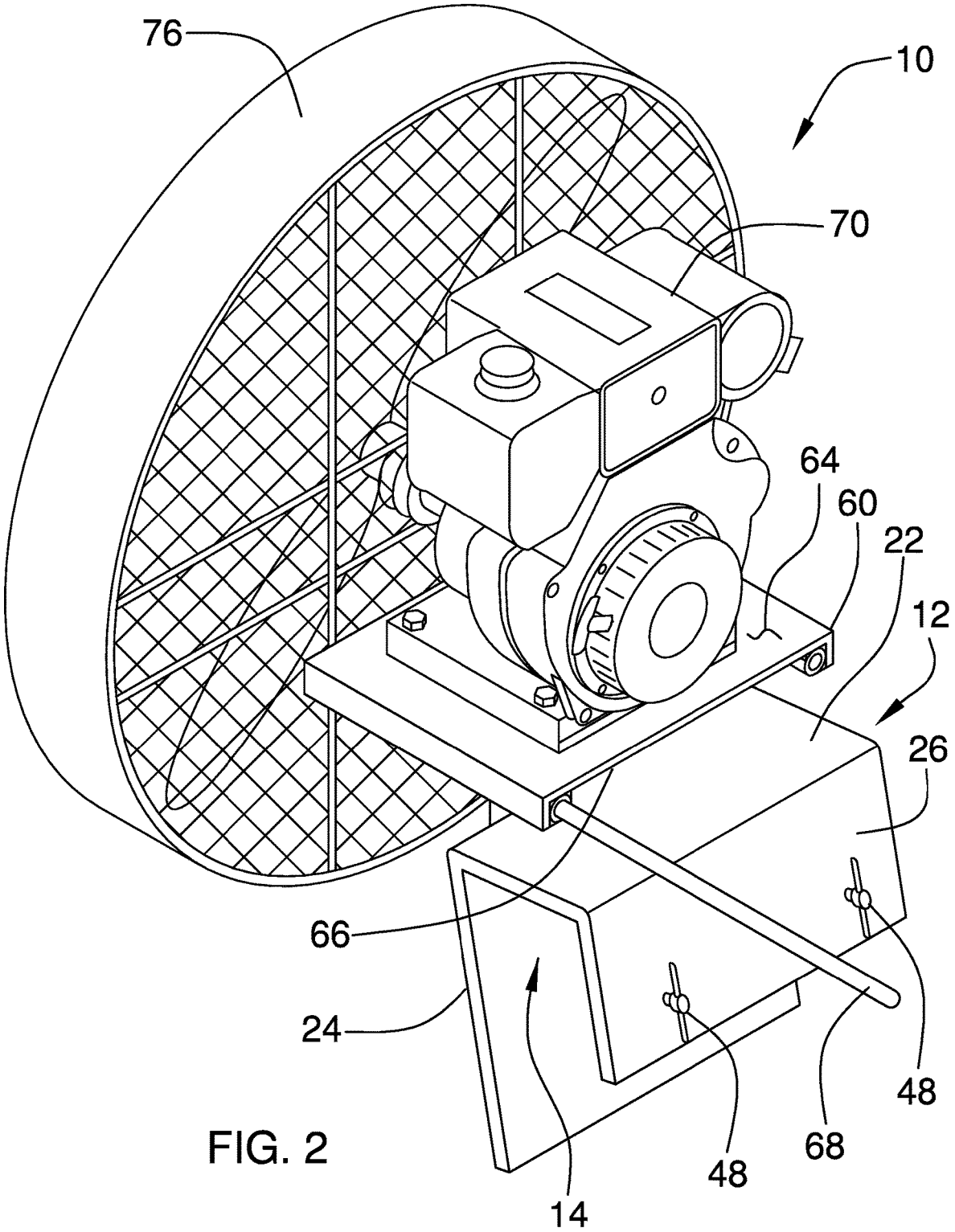
FIG. 2 is a back perspective view of an embodiment of the disclosure.
Figure 3:
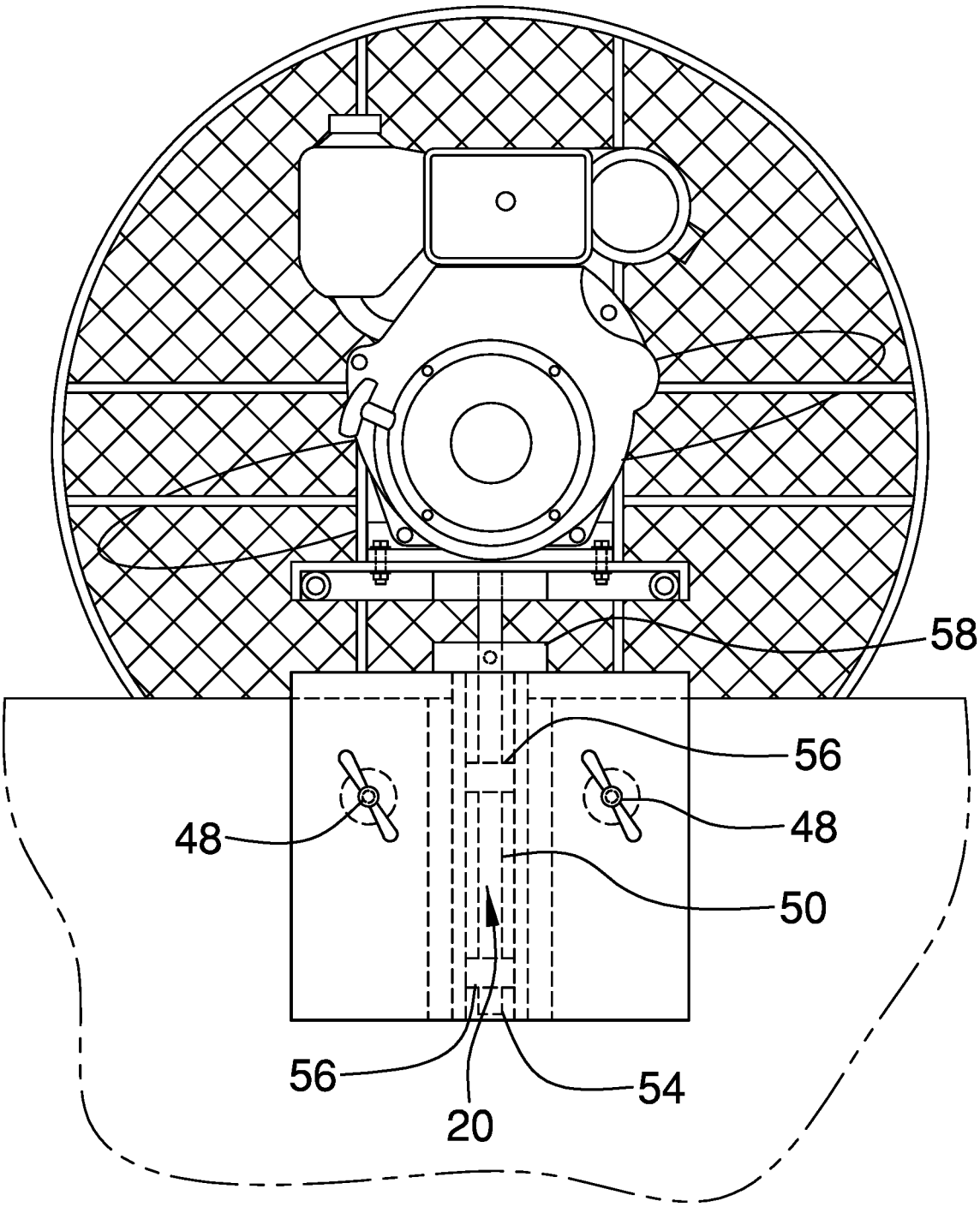
FIG. 3 is a back in-use view of an embodiment of the disclosure.
Figure 4:
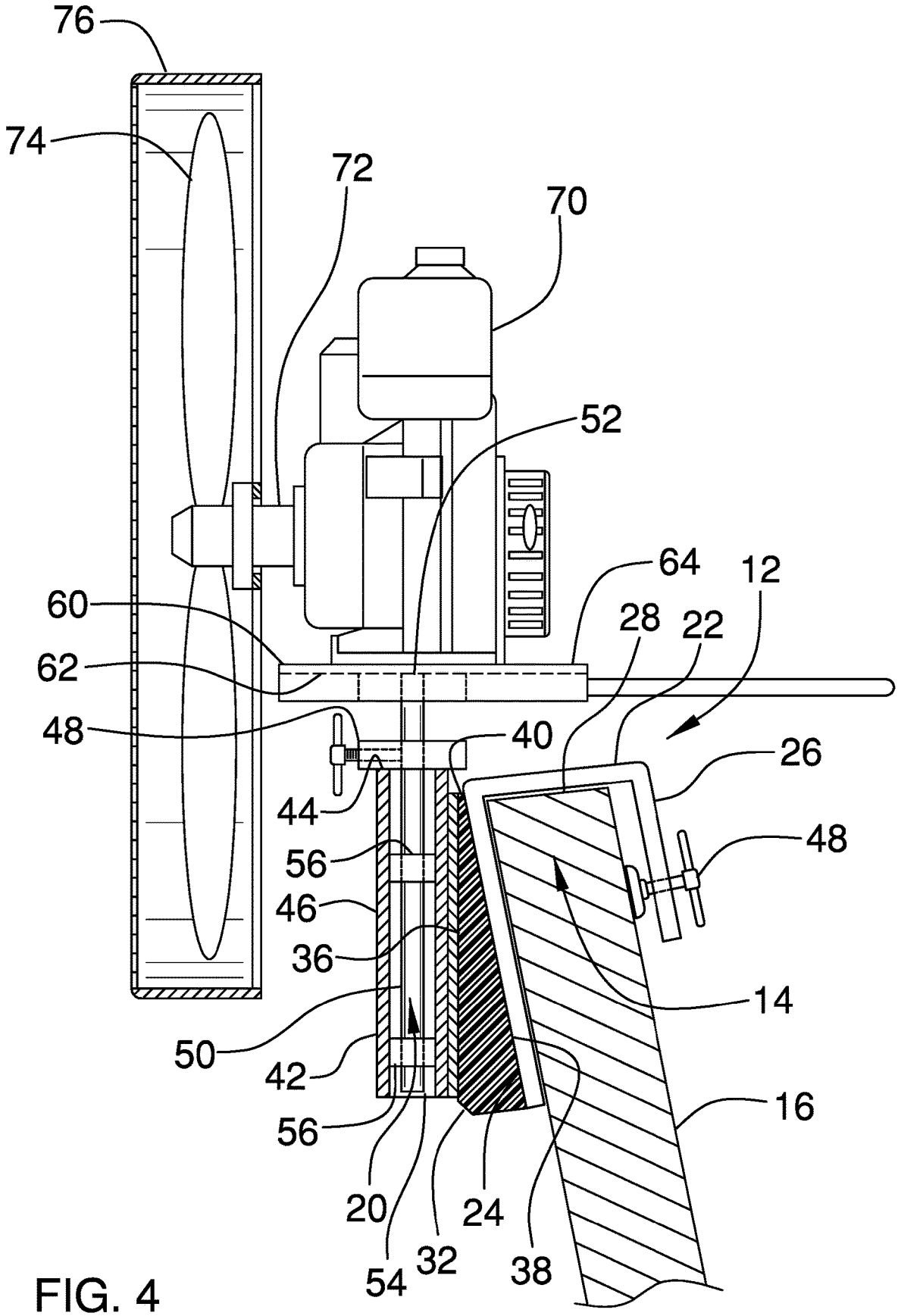
FIG. 4 is a right side cut-away view of an embodiment of the disclosure.
Figure 5:
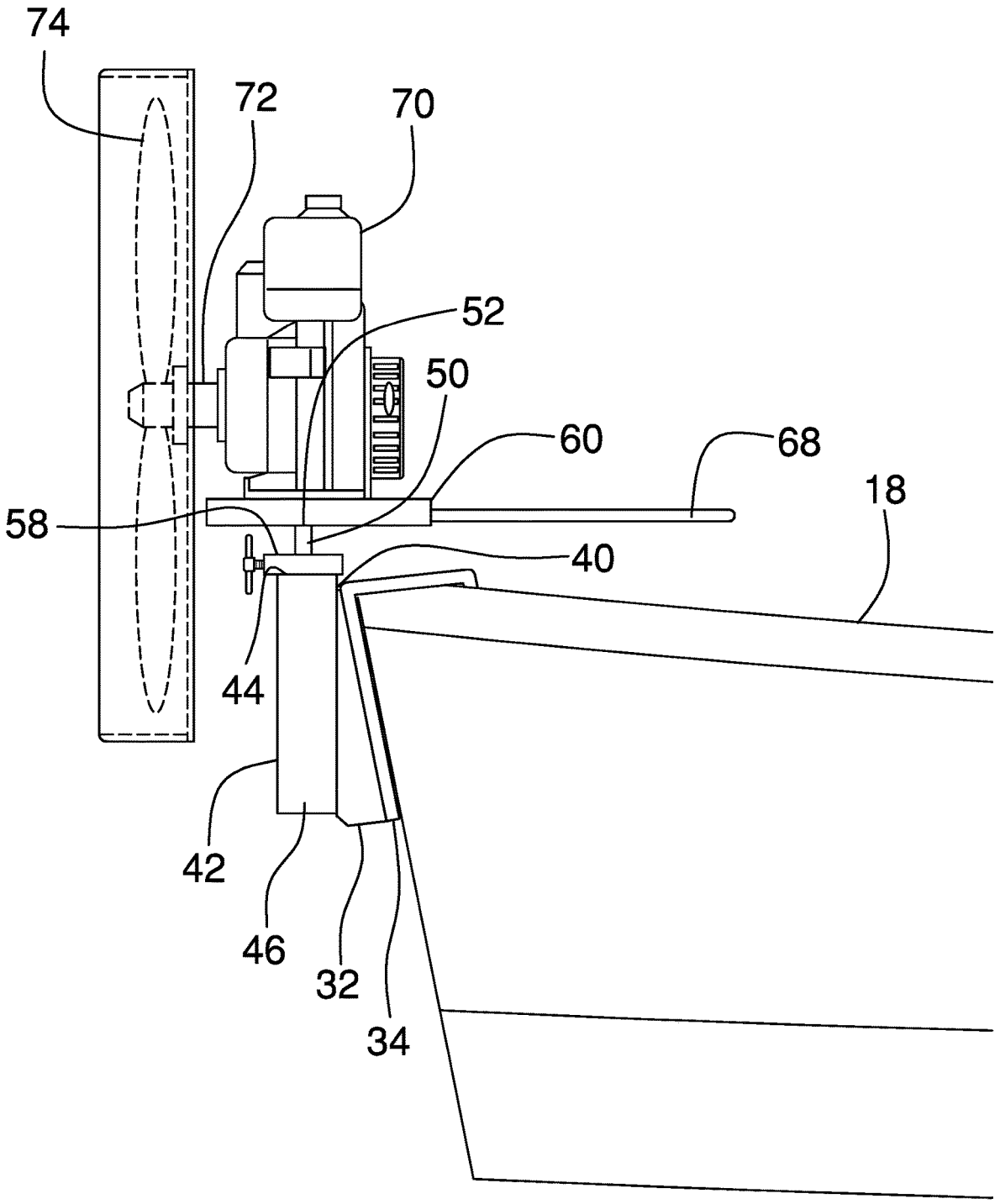
FIG. 5 is a perspective in-use view of an embodiment of the disclosure.

With reference now to the drawings, and in particular to FIGS. 1 through 5 thereof, a new propeller device embodying the principles and concepts of an embodiment of the disclosure and generally designated by the reference numeral 10 will be described.

As best illustrated in FIGS. 1 through 5, the air propeller assembly 10 generally comprises a mount 12 that has a gunwale slot 14 therein thereby facilitating the mount 12 to be mounted on a gunwale 16 of a boat 18. The boat 18 may be fishing boat or other boat having a length ranging between approximately 10 ft and 18 ft. The mount 12 has a rod channel 20 integrated therein. The mount 12 comprises a top panel 22 extending between a front panel 24 and a back panel 26. Each of the front panel 24 and the back panel 26 extends downwardly from the top panel 22. Moreover, the front panel 24 is spaced from the back panel 26 to define the gunwale slot 14 between the front panel 24 and the back panel 26. The top panel 22 rests upon a top surface 28 of the gunwale 16 when the gunwale 16 is positioned in the gunwale slot 14. The front panel 24 has a front surface 30 and the back panel 26 may have a length that is less than the length of the front panel 24.

A gusset 32 is coupled to the front surface 30 of the front panel 24 of the mount 12. The gusset 32 extends between the top panel 22 and a bottom edge 34 of the front panel 24. The gusset 32 is centrally positioned on the front panel 24. The gusset 32 has a forward surface 36 and a rearward surface 38. Additionally, the forward surface 36 and the rearward surface 38 intersect at a point 40 of the gusset 32. The rearward surface 38 is coupled to the front surface 30 of the front panel 24 having the forward surface 36 lying on a plane forming an acute angle with the front surface 30 of the front panel 24. Additionally, the point 40 of the gusset 32 is aligned with the top panel 22 of the mount 12. The forward surface 36 lies on a horizontal plane when the mount 12 is positioned on the gunwale 16.

A tube 42 is coupled to the mount 12 such that the tube 42 defines the rod channel 20. The tube 42 is vertically oriented when the mount 12 is positioned on the gunwale 16. The tube 42 has an upper end 44 and an outer wall 46, and the outer wall 46 is coupled to the forward surface 36 of the gusset 32. The tube 42 extends between the bottom edge 34 of the front panel 24 of the mount 12 and the top panel 22 of the mount 12. A pair of fasteners 48, such as screws or the like, each extends through the back panel 26 to engage the gunwale 16 and thusly retain the mount 12 on the gunwale 16.

A rod 50 slidably is slidably positioned in the rod channel 20. The rod 50 is rotatable about a vertical axis in the rod channel 20. The rod 50 has a top end 52 and a bottom end 54. The rod 50 extends outwardly through the upper end 44 of the tube 42 having the top end 52 of the rod 50 being exposed. A plurality of bearings 56 is each positioned around the rod 50. Each of the bearings 56 engages an interior surface of the outer wall 46 of the tube 42 to keep the rod 50 centrally positioned in the tube 42. A stop 58 is positioned around the rod 50 and the stop 58 is retained at a selected point 40 along the rod 50. The stop 58 abuts the upper end 44 of the tube 42 for spacing the top end 52 of the rod 50 a selected distance from the upper end 44.

A plate 60 is coupled to the rod 50 such that the plate 60 is horizontally oriented when the mount 12 is positioned on the gunwale 16. The plate 60 has a bottom surface 62, a top surface 64 and a rear edge 66. The bottom surface 62 is coupled to the top end 52 of the rod 50 and the rod 50 is centrally positioned on the bottom surface 62. A steering handle 68 is coupled to and extends away from the plate 60. The steering handle 68 can be gripped by a driver of the boat 18 and the plate 60 is rotatable about a longitudinal axis of the rod 50.

A motor 70 is provided and the motor 70 is coupled to the plate 60. The motor 70 is positioned on the top surface 28 of the plate 60. The motor 70 has a drive shaft 72 and the drive shaft 72 is directed rearwardly from the boat 18 when the mount 12 is positioned on the gunwale 16. The motor 70 may be an internal combustion motor.

A propeller 74 is provided and the propeller 74 is coupled to the motor 70. The motor 70 rotates the propeller 74 when the motor 70 is turned on. The propeller 74 agitates the air when the propeller 74 is rotated. In this way the propeller 74 can urge the boat 18 through shallow water without using a traditional boat motor that cannot function properly in the shallow water. The propeller 74 is positioned on the drive shaft 72 and the propeller 74 may be surrounded by a cage 76 to protect the propeller 74.

In use, the mount 12 is positioned on the gunwale 16 when the boat 18 is going to be operated in shallow water, grassy water or any other situation where a traditional boat motor would not function properly. The motor 70 is started to rotate the propeller 74, thereby urging the boat 18 by agitating air. Additionally, the steering handle 68 is gripped to point 40 the propeller 74 in a selected direction for steering the boat 18. The mount 12 can be removed from the gunwale 16 at any time for storing the mount 12, the motor 70 and the propeller 74.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An air propeller assembly being configured to be removably coupled to a boat thereby facilitating the boat to travel in shallow water, said assembly comprising:

a mount having a gunwale slot therein wherein said mount is configured to be mounted on a gunwale of a boat, said mount having a rod channel being integrated therein, said mount having a top panel extending between a front panel and a back panel, wherein the front of the assembly is configured to face outboard from a transom in an aft direction, each of said front panel and said back panel extending downwardly from said top panel, said front panel being spaced from said back panel to define said gunwale slot between said front panel and said back panel, said top panel resting upon a top surface of the gunwale when the gunwale is positioned in said gunwale slot, said front panel having a front surface;

a rod slidably being slidably positioned in said rod channel, said rod being rotatable about a vertical axis in said rod channel;

a plate being coupled to said rod such that said plate is horizontally oriented when said mount is positioned on the gunwale, a steering handle being coupled to and extending away from said plate wherein said steering handle is configured to be gripped by a driver of the boat, said plate being rotatable about a longitudinal axis of said rod;

a motor being coupled to said plate;

a propeller being coupled to said motor, said motor rotating said propeller when said motor is turned on, propeller agitating the air when said propeller is rotated wherein said propeller is configured to urge the boat through shallow water; and a gusset being coupled to said front surface of said front panel of said mount, said gusset extending between said top panel and a bottom edge of said front panel, said gusset being centrally positioned on said front panel, gusset having a forward surface and a rearward surface, said forward surface and said rearward surface intersecting at a point of said gusset, said point of said gusset being aligned with said top panel of said mount.

2. The assembly according to claim 1, wherein said rearward surface is coupled to said front surface of said front panel having said forward surface lying on a plane forming an acute angle with said front surface of said front panel, said forward surface lying on a vertical plane when said mount is positioned on the gunwale.

3. The assembly according to claim 2, further comprising a tube being coupled to said mount such that said tube defines said rod channel, said tube being vertically oriented when said mount is positioned on the gunwale, said tube having an upper end and an outer wall, said outer wall being coupled to said forward surface of said gusset, said tube extending between said bottom edge of said front panel of said mount and said top panel of said mount.

4. The assembly according to claim 3, wherein said rod has a top end and a bottom end, said rod extending outwardly through said upper end of said tube having said top end of said rod being exposed.

5. The assembly according to claim 4, further comprising a plurality of bearings, each of said bearings being positioned around said rod, each of said bearings engaging an interior surface of said outer wall of said tube to keep said rod centrally positioned in said tube.

6. The assembly according to claim 5, further comprising a stop being positioned around said rod, said stop being retained at a selected point along said rod, said stop abutting said upper end of said tube for spacing said top end of said rod a selected distance from said upper end.

7. The assembly according to claim 4, wherein said plate has a bottom surface, a top surface and a rear edge, said bottom surface being coupled to said top end of said rod having said rod being centrally positioned on said bottom surface.

8. The assembly according to claim 7, wherein said motor is positioned on said top surface of said plate, said motor having a drive shaft, said drive shaft being directed rearwardly from the boat when said mount is positioned on the gunwale.

9. An air propeller assembly being configured to be removably coupled to a boat thereby facilitating the boat to travel in shallow water, said assembly comprising:

a mount having a gunwale slot therein wherein said mount is configured to be mounted on a gunwale of a boat, said mount having a rod channel being integrated therein, said mount having a top panel extending between a front panel and a back panel, wherein the front of the assembly is configured to face outboard from a transom in an aft direction, each of said front panel and said back panel extending downwardly from said top panel, said front panel being spaced from said back panel to define said gunwale slot between said front panel and said back panel, said top panel resting upon a top surface of the gunwale when the gunwale is positioned in said gunwale slot, said front panel having a front surface;

a gusset being coupled to said front surface of said front panel of said mount, said gusset extending between said top panel and a bottom edge of said front panel, said gusset being centrally positioned on said front panel, gusset having a forward surface and a rearward surface, said forward surface and said rearward surface intersecting at a point of said gusset, said rearward surface being coupled to said front surface of said front panel having said forward surface lying on a plane forming an acute angle with said front surface of said front panel, said point of said gusset being aligned with said top panel of said mount, said forward surface lying on a vertical plane when said mount is positioned on the gunwale;

a tube being coupled to said mount such that said tube defines said rod channel, said tube being vertically oriented when said mount is positioned on the gunwale, said tube having an upper end and an outer wall, said outer wall being coupled to said forward surface of said gusset, said tube extending between said bottom edge of said front panel of said mount and said top panel of said mount;

a rod slidably being slidably positioned in said rod channel, said rod being rotatable about a vertical axis in said rod channel, said rod having a top end and a bottom end, said rod extending outwardly through said upper end of said tube having said top end of said rod being exposed;

a plurality of bearings, each of said bearings being positioned around said rod, each of said bearings engaging an interior surface of said outer wall of said tube to keep said rod centrally positioned in said tube;

a stop being positioned around said rod, said stop being retained at a selected point along said rod, said stop abutting said upper end of said tube for spacing said top end of said rod a selected distance from said upper end;

a plate being coupled to said rod such that said plate is horizontally oriented when said mount is positioned on the gunwale, said plate having a bottom surface, a top surface and a rear edge, said bottom surface being coupled to said top end of said rod having said rod being centrally positioned on said bottom surface;

a steering handle being coupled to and extending away from said plate wherein said steering handle is configured to be gripped by a driver of the boat, said plate being rotatable about a longitudinal axis of said rod;

a motor being coupled to said plate, said motor being positioned on said top surface of said plate, said motor having a drive shaft, said drive shaft being directed rearwardly from the boat when said mount is positioned on the gunwale; and a propeller being coupled to said motor, said motor rotating said propeller when said motor is turned on, propeller agitating the air when said propeller is rotated wherein said propeller is configured to urge the boat through shallow water, said propeller being positioned on said drive shaft.

* * * * *